United States Patent [19]

Maeno

[11] 4,126,841

[45] Nov. 21, 1978

[54] OVERCURRENT SWITCH

[75] Inventor: Chiaki Maeno, Suzaka, Japan

[73] Assignee: Fujitsu Limited, Japan

[21] Appl. No.: 811,681

[22] Filed: Jun. 30, 1977

Related U.S. Application Data

[63] Continuation of Ser. No. 600,139, Jul. 30, 1975, abandoned.

[30] Foreign Application Priority Data

Jul. 31, 1974 [JP] Japan ..... 49-87619

[51] Int. Cl.[2] ..... H01H 51/00

[52] U.S. Cl. ..... 335/154; 335/154; 335/205

[58] Field of Search ..... 335/151, 153, 154, 205, 335/206, 207

[56] References Cited

U.S. PATENT DOCUMENTS

| | | | |
|---|---|---|---|
| 3,204,059 | 8/1965 | Saaty | 335/153 |
| 3,227,838 | 1/1966 | Hoeppel | 335/153 |
| 3,477,046 | 11/1969 | Pigeon et al. | 335/206 X |
| 3,486,144 | 12/1969 | Paige | 335/207 X |

OTHER PUBLICATIONS

IBM Technical Disclosure Bulletin, vol. 6, No. 11, Apr. 1964, p. 40.

*Primary Examiner*—George Harris
*Attorney, Agent, or Firm*—Staas & Halsey

[57] ABSTRACT

An overcurrent switch is described, comprising a reed switch for series connection in an electric circuit to break the flow of an overcurrent therethrough. A magnetizing element applies a magnetic field to the reed switch, and a setting device controls the magnetic field so that at least two levels of magnetic field intensity are selectively applied to the reed switch.

8 Claims, 8 Drawing Figures

I [A]
2
I'h
Ih
Iℓ
c
H2ℓ
H2h
H'2h
H'2ℓ
20
30
H2
SWITCH OFF
(at current Ih)
SWITCH ON
(at current Ih)

B
SWITCH OFF
(at current Iℓ)
SWITCH ON
(at current Iℓ)
③-1
③-2
②
④-ℓ
④-h
①-1
H'2h
H2ℓ
H2h
H1
Hm
H

OVERCURRENT SWITCH

This is a continuation of application Ser. No. 600,139 filed July 30, 1975 now abandoned.

BACKGROUND OF THE INVENTION

The present invention relates, generally, to an overcurrent switch which protects an electric circuit from being damaged by an overcurrent, and more particularly relates to a midget overcurrent relay which is comprises a conventional reed relay.

An overcurrent switch is one of the most important electric parts of an electric circuit. It acts to protect the electric circuit from being damaged by an overcurrent which flows in the electric circuit when a malfunction occurs. In the prior art, there are typically three kinds of overcurrent protective devices. A first type of overcurrent protective device is a fuse which is fusible with heat. When an overcurrent flow through the fuse connected in series with an electric circuit, the fuse disintegrates with heat and, accordingly, stops the current from flowing through the electric circuit. A second type of overcurrent protective device is an electromagnetic relay. It comprises an electromagnetic coil and a mechanical switch which is electromagnetically actuated by a current flowing through the electromagnetic coil. When an overcurrent flows in an electric circuit connected through the mechanical switch and also flow through the electromagnetic coil, the electromagnetic coil actuates the mechanical switch and turns the mechanical switch OFF. The overcurrent then ceases to flow through the electric circuit. A third type of overcurrent protective device is an electronic switch which comprises one or more transistors. When an overcurrent flows through an electric circuit, in which the electronic switch is installed, a voltage exceeding a predetermined voltage level is applied to a base electrode of a first transistor. Then, the first transistor turns ON and turns a second transistor OFF, causing the overcurrent to cease flowing through the electric circuit.

Each of the three types of overcurrent protective devices mentioned above has a well known defect. These defects are as follows.

A fuse, that is the above-mentioned first type of overcurrent protective device, disintegrates with heat once an overcurrent flows therethrough. Accordingly, one fuse can not be used over and over again, and once an overcurrent flows through a fuse it has to be exchanged for a new one. An electromagnetic relay, that is the above-mentioned second type of overcurrent protective device, is relatively big and heavy. An electronic switch, that is the above-mentioned third type of overcurrent protective device, is small and light and, further, can be used over and over again. However, since the electronic switch is comprised of transistors, it is easily damaged by an excessively high current or an excessive over-voltage.

Therefore, it is the principal object of the present invention to provide an overcurrent switch which can be used over and over again, is relatively small, lightweight and is durable with respect to an excessive overcurrent and/or an excessive over-voltage. It is another object of the present invention to provide an overcurrent switch which can be constructed simply by utilizing a conventional reed switch and a few simple components attached thereto; and in which the threshold, at which the flow of overcurrent through the electrical circuit is to be stopped, is easily and freely predetermined by using the overcurrent switch.

The present invention will be more apparent from the ensuing description with reference to the accompanying drawings wherein.

Figure 1:
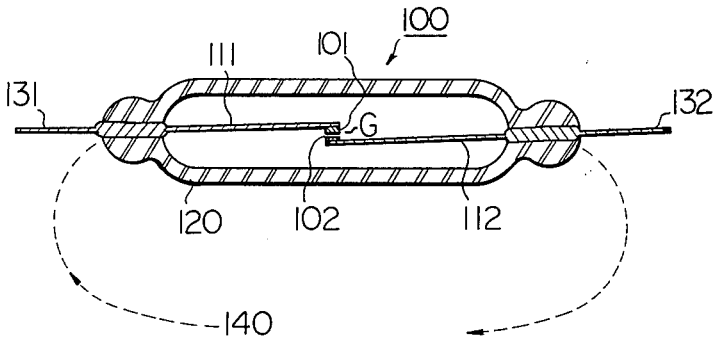
FIG. 1 shows a sectional view of a typical conventional reed switch.

FIG. 1 shows a sectional view of a typical conventional reed switch 100. In FIG. 1, 101 and 102 are, reference numerals respectively, a first contact and a second contact. The first contact 101 and the second contact 102 are, respectively, fixed to a first contact reed spring 111 and a second contact reed spring 112. Both the first and second contact reed springs are supported by a glass housing 120 in such a manner that a small air gap G is formed between the first and the second contacts (101 and 102). The first and second contacts, and the first and second contact reed springs are packaged in the glass housing 120 together with an inert gas. When no magnetic field is applied to the reed switch 100 and, accordingly, said small air gap G is still maintained as it is shown in FIG. 1, an electric current cannot flow between a first reed terminal 131 and a second reed terminal 132. As a result, the reed switch 100 is open (OFF). When a magnetic field (schematically shown by dotted line 140 in FIG. 1) is applied to the reed switch 100, the first and second contact reed springs, which are made of magnetic material, are both magnetized in a direction along an axis of the reed switch 100. At that time a magnetic attractive force occurs between the first and the second contact reed springs and, accordingly, the gap distance of said small air gap G becomes zero. As a result, an electric current can flow between the first and the second reed terminals (131 and 132) and the reed switch 100 is closed (ON). When said magnetic field (140) is released or diminshed, the resilient forces of the first and the second contact reed springs overcome said magnetic attractive force therebetween, cuasing the reed switch 100 to open, forming the small air gap G again and thus in its open position (OFF).

Figure 2:
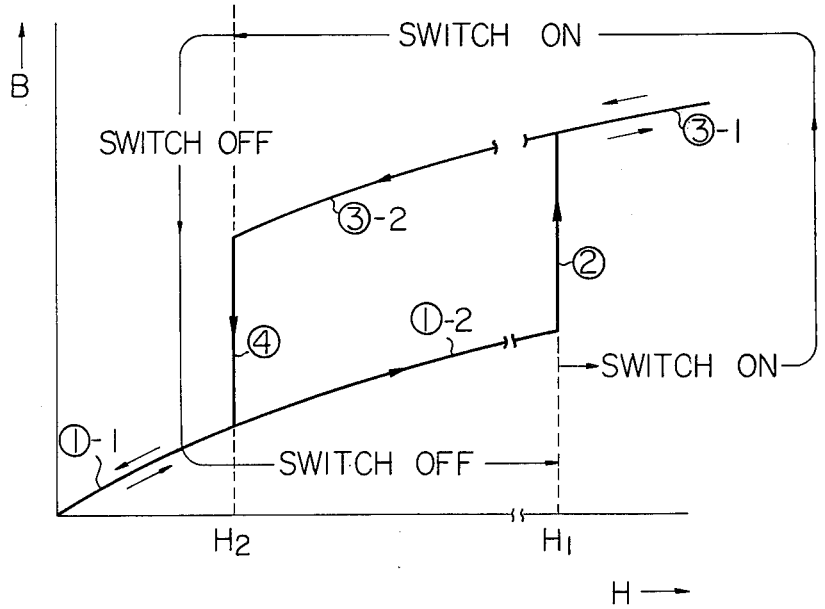
PRIOR ART Fig. 2
FIG. 2 is a graph showing changes of the magnetic flux density (B) which occurs in a first and a second contact reed spring both contained in a reed switch, with respect to an intensity of a magnetic-field (H) which is applied to the reed switch.

It is a well-known characteristic that an intensity of a magnetic field (140 in FIG. 1) at which the reed switch 100 closes (ON), is higher than an intensity of a magnetic field at which the reed switch 100 opens (OFF). An intensity of a magnetic field at which the reed switch 100 closes, (ON), is the so-called pull-in intensity of the magnetic field, while an intensity of a magnetic field at which the reed switch 100 opens (OFF) is the so-called drop-out intensity of the magnetic field. The above-mentioned well-known characteristic is clarified by the graph which is shown in FIG. 2. In FIG. 2, the abscissa indicates the intensity of a magnetic field (H) which is applied to the reed switch 100 (FIG. 1) and the ordinate indicates the magnetic flux density (B) which occurs both in the first contact reed spring 111 (FIG. 1) and the second contact reed spring 112 (FIG. 1). During the time a magnetic field (shown in FIG. 1 as 140) is applied to the reed switch 100 (FIG. 1) and the intensity of the magnetic field H increases toward the pull-in intensity of the magnetic field $H_1$, the magnetic flux density B, which occurs both in the first and second contact reed springs, also increases along the lines ①-1 and ①-2. At the time the intensity of the magnetic field H reaches the pull-in intensity of the magnetic field $H_1$, the magnetic attractive force becomes high enough to overcome the spring forces and bring the first and second contact reed springs (111 and 112 in FIG. 1) close enough together for the first contact 101 and the second contact 102 to make contact with each other. The reed switch thereby closes, which is indicated by words "switch ON". At this time, since the first and second contact reed springs are magnetically shorted, the magnetic reluctance between the first reed terminal (131 in FIG. 1) and the second reed terminal (132 in FIG. 1), suddenly decreases. Accordingly, the magnetic flux density B suddenly increases along the line ② in FIG. 2. Then, as the intensity of the magnetic field H further increases from $H_1$, the magnetic flux density B also increases along line ③-1 in FIG. 2. Next, as the intensity of the magnetic field H decreases, the magnetic flux density B also decreases along line ③-1 and ③-2 in FIG. 2, where it should be noted that the reed switch (100 in FIG. 1) can not open its first and second contacts (101 and 102 in FIG. 1) even though the intensity of the magnetic field H decreases below the pull-in intensity of magnetic field $H_1$. When the intensity of the magnetic field H reaches the drop-out intensity of magnetic field $H_2$ for the first time, the reed switch (100 in FIG. 1) opens its first and second contacts (101 and 102 in FIG. 1). Thereby, the reed switch opens, which is indicated by words "switch OFF". At this time, since a magnetic circuit formed through the first and second contact reed springs is opened, the magnetic reluctance between the first reed terminal (131 in FIG. 1) and the second reed terminal (132 in FIG. 1), suddenly increases. Accordingly, the magnetic flux density B suddenly decreases along the line ④ in FIG. 2. Then, as the intensity of the magnetic field H further decreases from $H_2$, the magnetic flux density B also decreases along the line ①-1 in FIG. 2. Thus, in the reed switch, the relation between the intensity of the magnetic field H and the intensity of the magnetic flux density B, provides a hysteresis loop as shown in FIG. 2.

Figures 3A, 3B:
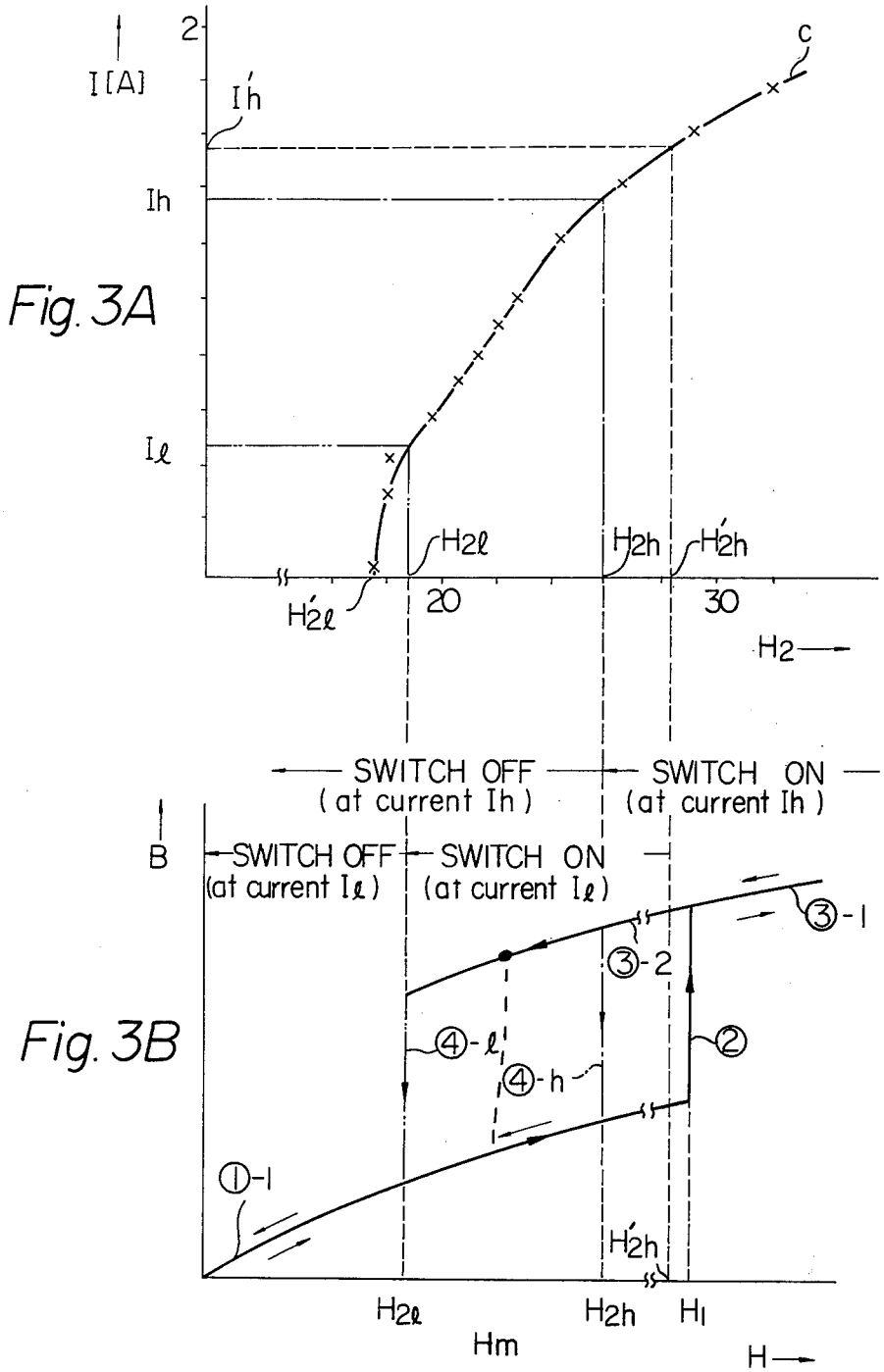
FIG. 3A is a graph showing changes of the intensity of a magnetic-field $H_2$ at which the reed switch opens its first and second contacts, with respect to an amplitude of an electric current I which flows through the first and second contacts before these contacts open.
FIG. 3B is a graph showing changes of the magnetic flux density (B) which occurs in the first and the second contact reed springs, with respect to both the amplitude of an electric current which flows through the contacts and the intensity of the magnetic-field (H) which is applied to the reed switch.

The characteristic curve of a reed switch, as shown in FIG. 2, is obtained only when there is no electric current flow between the first and the second reed terminals (131 and 132 in FIG. 1). However, in various kinds of experiments, the inventor discovered that the above-mentioned drop-out intensity of the magnetic field $H_2$ (in FIG. 2) is not fixed, but is variable in accordance with changes in the amplitude of the electric current which flows between said first and second reed terminals of the reed switch 100. FIG. 3A illustrates the above-mentioned fact that the drop-out intensity of the magnetic field $H_2$ (FIG. 2) is variable in accordance with changes in the amplitude of an electric current which flows through a reed switch immediately before the time the contacts of the reed switch open. In FIG. 3A, the ordinate indicates the amplitude of electric current I[A] which flows through the reed switch immediately before the time the contacts of the reed switch open, and the abscissa indicates the drop-out intensity of magnetic field $H_2$.

As is apparent from the characteristic curve C shown in FIG. 3A, in the case where an electric current I, which flows through the reed switch 100 immediately before the first and second contacts (111 and 112) open, is a relatively low value $I_l$, for example $I_l=0.46$ [A], then the drop-out intensity of the magnetic field $H_2$ is a relatively low value $H_{2l}$, for example $H_{2l}=19[AT]$. On the other hand, in the case where an electric current I is a relatively high value $I_h$, for example $I_h=1.37[A]$, then the drop-out intensity of the magnetic field $H_2$ is a relatively high value $H_{2h}$, for example $H_{2h}=26[AT]$.

The reason for the above-mentioned fact is not completely clear. However, one reason may be as follows. In the case where an electric current which flows through a reed switch is relatively high, a magnetic field which is produced by the relatively high electric current lowers the intensity of the magnetic field H (indicated as 140 in FIG. 1) which is produced by a magnetizing element (not shown in FIG. 1), for example a permanent magnet or a electromagnetic driving coil. Consequently, the first and second contact reed springs (111 and 112) may not be strongly attracted together and, thus, the drop-out intensity of the magnetic field will be relatively high. Another reason may be as follows. In the case in which an electric current which flows through a reed switch is relatively high, the first and the second contact reed springs (111 and 112) are heated thereby. Then, the intensity of the magnetization in said first and second contact reed springs, which are made of magnetic material, is lowered by the high temperature caused by the heat. It is a well-known phenomenon that the intensity of magnetization in magnetic material gradually decreases in proportion to an increasing temperature thereof and, finally, reaches zero when the increasing temperature reaches a magnetically critical temperature. It is obvious that the reed switch is easily opened when the intensity of magnetization in the first and second contact reed springs is lowered.

In view of the above, the characteristic curve (especially the line ④ shown in FIG. 2) has to be modified when an electric current flows through the reed switch 100. The modified characteristic curve is shown in FIG. 3B, wherein the abscissa and the ordinate respectively indicate the same as those of the FIG. 2. As shown in FIG. 3B, when the contacts of reed switch 100 are closed and a relatively low electric current $I_l$ (selected as the lower end of the linear operating portion of the curve C shown in FIG. 3A) flows through the reed switch, the contacts of the reed switch open (switch OFF) at a relatively low drop-out intensity of the magnetic field $H_{2l}$. (FIGS. 3A and 3B) through the line ④-l. When the contacts of reed switch 100 are closed and a relatively high electric current $I_h$ (selected as the upper end of the linear operating portion of the curve C shown in FIG. 3A) flows through the reed switch, the contacts of the reed switch open (switch OFF) at a relatively high drop-out intensity of the magnetic field $H_{2h}$ (FIGS. 3A and 3B) through the line ④h. Consequently, it is easily seen that a unique overcurrent switch may be created based on the characteristic curve which is shown in FIG. 3B. The preferred embodiment of a unique overcurrent switch is produced by selectively setting the intensity of the magnetic field $H_m$ between the intensities of the drop-out magnetic fields $H_{2l}$ and $H_{2h}$ (FIG. 3B). That is to say, the intensity of the magnetic field $H_m$ (FIG. 3B), which is applied to the reed switch 100 (FIG. 1) along the line 140 (FIG. 1), is set as $H_{2l}<H_m<H_{2h}$. It should be noted that the upper intensity of the maximum drop-out magnetic field $H_{2h}$ can be predetermined at a value up to the intensity of the pull-in magnetic field $H_1$ (i.e., up to $H_{2h}$, which is just less than $H_1$). During normal conditions, a relatively low electric current, which is below the rated current of the electric circuit to be protected by the reed switch and is lower than $I_l$ (FIG. 3A), flows through the closed reed switch. In this condition, the reed switch will open (switch OFF) at an intensity of the magnetic field which is lower than the drop-out intensity of the magnetic field $H_{2l}$ (FIG. 3B). However, since the predetermined intensity of the magnetic field $H_m$, which is continuously applied to the reed switch, is higher than the drop-out intensity of the magnetic field $H_{2l}$, (i.e., $H_{2l}<H_m$), the reed switch will not open during rated current conditions (switch OFF). Thus, during normal conditions when no overcurrent flows through the reed switch it is maintained closed (switch ON).

On the other hand, during an abnormal condition a relatively high electric current flows through the reed switch which exceeds, the rated current (an overcurrent) and is higher than $I_h$ (FIG. 3A). In this condition, the reed switch is opened through the line ④h (FIG. 3B). This is because the drop-out intensity of the magnetic field $H_{2h}$ is higher than the predetermined intensity of the magnetic field $H_m$, that is $H_m<H_{2h}$. As a result, the reed switch opens, and the overcurrent which is higher than $I_h$ (FIG. 3A), ceases to flow. An electric circuit in series with the reed switch is thus protected from being damaged by the overcurrent.

Figure 4:
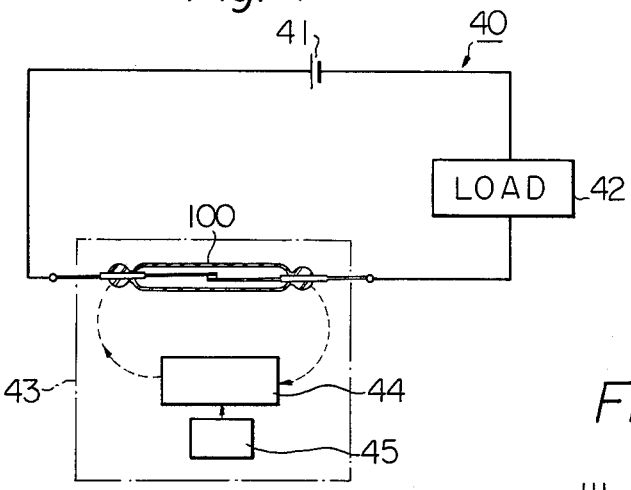
FIG. 4 shows a basic model of an electric circuit which includes an overcurrent switch according to the present invention.

FIG. 4 shows a basic model of an example of the electric circuit to which the overcurrent switch of the present invention is applied. In FIG. 4, reference numeral 40 is an electric circuit which comprises at least a power supply 41, a load 42 and an overcurrent switch 43, according to the present invention. When an overcurrent flows in the electric circuit 40, the overcurrent switch 43 immediately opens its contacts (reed switch 100) and stops the flow of the overcurrent in the electric circuit 40. In addition to the reed switch 100, the overcurrent switch 43 further comprises a magnetizing element 44 which applies a magnetic field (indicated as 140 in FIG. 1) to the reed switch 100, and a setting device 45 which controls the intensity of the magnetic field so as to selectively apply at least two levels of magnetic field intensity to the reed switch 100, for example $H_m$ and $H_1$ (shown in FIG. 3B). The function of the setting device 45 will be apparent from the ensuing discription of embodiments according the present invention.

Figure 5:
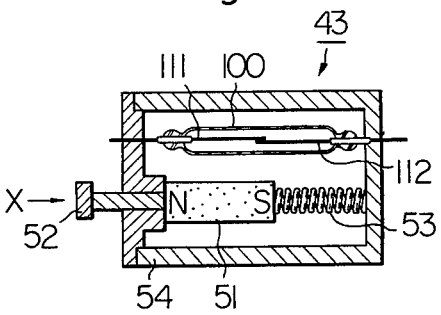
FIG. 5 is a sectional view showing a first embodiment of an overcurrent switch according to the present invention.

FIG. 5 is a sectional view showing a first embodiment of the overcurrent switch 43 shown in FIG. 4. In FIG. 5, the overcurrent switch 43 comprises the reed switch 100, a permanent magnet 51 which corresponds to the magnetizing element 44 shown in FIG. 4, a push button 52 and a coil spring 53 which correspond to the setting device 45 shown in FIG. 4, and a housing 54 which preferrably acts as a magnetic shield. The permanent magnet 51 is connected to an end of the push button 52 and the push button 52 together with the permanent magnet 51, is slidably supported by the housing 54. When the push button 52 is not being operated, the permanent magnet 51 is pushed against a wall of the housing 54 by means of the coil spring 53. When the electric circuit 40 (FIG. 4) is required to operate, the push button 52 is pushed in a direction X in FIG. 5 against the coil spring 53. At that time, the center of the permanent magnet 51 is adjacent the center of the reed switch 100, whereby the maximum intensity of the magnetic field, which is higher than the pull-in intensity of the magnetic field $H_1$ (FIG. 3B), is applied to the reed switch 100. Then, the first and second contact reed springs (111 and 112 in FIG. 5) of the reed switch 100 are attracted towards each other, and the reed switch 100 closes (switch ON). Next, the push button 52 is released and the center of the permanent magnet 53 moves away from the center of the reed switch 100, whereby the intensity of the magnetic field, which is applied to the reed switch 100, decreases along the lines ③-1 and ③-2 in FIG. 3B and reaches the predetermined intensity of the magnetic field $H_m$ ($H_{2l}<H_m<H_{2h}$) which is set within the linear operating range shown in FIG. 3A. As a result, the intensity of the magnetic field, which is applied to the reed switch 100, is held at $H_m$, where the reed switch 100 is kept closed (switch ON) and the electric circuit 40 (FIG. 4) is maintained in an energized condition. During normal conditions a relatively low electric current, which is a rated current determined by the $H_m$ setting is lower than $I_l$ (FIG. 3A) and flows in the reed switch 100. As previously mentioned, in this condition, since the predetermined intensity of the magnetic field $H_m$, which is continuously applied to the reed switch, is higher than the drop-out intensity of the magnetic field $H_{2l}$, (i.e., $H_{2l}<H_m$), the reed switch 100 will not open (switch OFF). Thus during normal conditions when no overcurrent flows, the reed switch 100 is maintained closed (switch ON). On the other hand, during an abnormal condition a relatively high electric current, namely an overcurrent which exceeds the rated current determined by the $H_m$ setting is higher than $I_h$ (FIG. 3A), and flows through the reed switch. In this condition. the reed switch opens (switch OFF) through the line ④h (FIG. 3B). This is because the drop-out intensity of the magnetic field $H_{2h}$ is higher than the predetermined intensity of the magnetic field $H_m$ (i.e., $H_m<H_{2h}$). As a result, the reed switch breaks the overcurrent which is higher than $I_h$ (FIG. 3A), and the electric circuit 40 (FIG. 4), which includes the reed switch 100, is protected from being damaged thereby.

Figure 6:
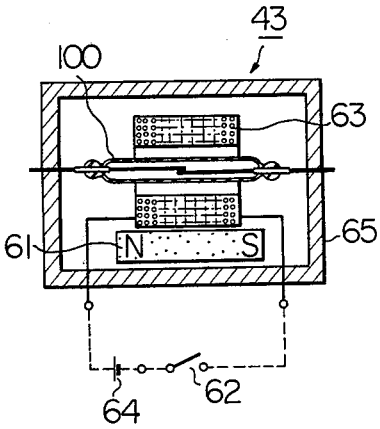
FIG. 6 is a sectional view showing a second embodiment of an overcurrent switch according to the present invention.

FIG. 6 is a sectional view showing a second embodiment of the overcurrent switch 43 shown in FIG. 4. In FIG. 6, the overcurrent switch 43 comprises: the reed switch 100; a permanent magnet 61, which corresponds to the magnetizing element 44 shown in FIG. 4; a mechanical or electronic switch 62 and an electromagnetic driving coil 63, which correspond to the setting device 45 shown in FIG. 4; a power source 64, which energizes the electromagnetic driving coil 63; and a housing 65 which preferably acts as a magnetic shield. When the electric circuit 40 (FIG. 4) is required to operate, the mechanical or electronic switch 62 is closed and the electromagnetic driving coil 63 is energized by the power source 64. A magnetic field, which is produced by the electromagnetic driving coil 63, is positively added to a magnetic field which is produced by the permanent magnet 61. As a result, the intensity of the combined magnetic fields applied to the reed switch 100, is higher than the pull-in intensity of the magnetic field $H_1$ (FIG. 3B) and the reed switch 100 becomes conductive (switch ON). Next, the mechanical or electronic switch 62 is opened (switch OFF) and only the magnetic field which is produced by the permanent magnet 61 is applied to the reed switch 100. Consequently, the intensity of the magnetic field decreases along the line ③-1 and ③-2 in FIG. 3B and reaches the intensity of the magnetic field $H_m$ ($H_{2l}<H_m<H_{2h}$) which is determined by the permanent magnet 61. As a result, the reed switch 100 is kept conductive under normal rated conditions and the electric circuit 40 (FIG. 4) is maintained in an energized condition. During an abnormal condition, since the disconnective intensity of the magnetic field $H_{2h}$ is higher than the predetermined intensity of the magnetic field $H_m$, (i.e., $H_m<H_{2h}$), the reed switch 100 opens and thereby prevents the overcurrent which is higher than $I_h$ (FIG. 3A), from damaging the electric circuit 40 (FIG. 4).

In the above mentioned first and second embodiments, according to the present invention, it should be noted that the overcurrent rating, for which the overcurrent switch opens, is freely selected. For example, if the intensity of the magnetic field $H_m$ applied to the reed switch is chosen as $H_{2h}'$, shown in FIGS. 3A and 3B, the over current switch will open only when the amplitude of overcurrent is higher than $I_h'$, shown in FIG. 3A.

Figure 7:
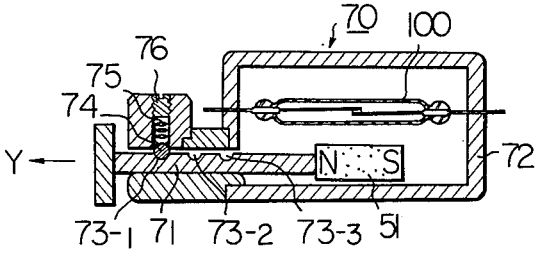
FIG. 7 is a sectional view, showing a modified embodiment based on the first embodiment.

FIG. 7 is a sectional view showning a modified embodiment based on the first embodiment. The modified embodiment provides a switch 70 which is not only an overcurrent switch but also a conventional ON-OFF switch. In FIG. 7, the permanent magnet 51 is connected to the end of an operation bar 71. The operation bar 71 is slidably supported by a housing 72. Further, three recesses 73-1, 73-2 and 73-3, which are formed on the operation bar 71, engage mechanically with a ball 74 which is pushed against the operation bar 71 by a coil spring 75, mounted in the housing 72, by means of a bolt 76. When the ball 74 engages the recess 73-1, as shown in FIG. 7, the permanent magnet 51 faces right in front of the reed switch 100, whereby an intensity of the magnetic field higher than the pull-in intensity of the magnetic field $H_1$ is applied to the reed switch. As a result the switch 70 acts as a conventional ON-OFF switch which is closed (ON). When the operation bar 71 is pulled in a direction Y, shown in FIG. 7, where the ball 74 engages the recess 73-2, the switch 70 acts as an overcurrent switch, as previously explained with reference to FIG. 5. When the ball 74 engages the recess 73-3, there is not enough magnetic field intensity to maintain the reed switch closed, since at that setting $H_m<H_2$. In such case the switch 70 acts as a conventional ON-OFF switch which is open (OFF).

As mentioned above, the overcurrent switch, of the present invention, is a unique and excellent overcurrent switch which can be used over and over again. It is relatively small, lightweight and is durable with respect to an excessive overcurrent and an excessive overvoltage. Further, the overcurrent switch is constructed simply by using only a few simple components; and the amplitude of the overcurrent which is to be stopped flowing through an electric circuit, can be easily and freely predetermined. Furthermore, the overcurrent switch, according to the present invention, can also perform the functions of a conventional ON-OFF switch.

What is claimed is:

1. In an overcurrent switch serially connected in a circuit for interrupting the flow of current therethrough when an overcurrent is detected, the switch comprising:

a pair of electrically conductive contacts actuable to an open position by application of a magnetic field of intensity equal to or less than a predetermined drop-out level and actuable to a closed position by application of a magnetic field of intensity equal to or greater than a predetermined pull-in level; and first means for initially applying to said pair of contacts a magnetic field of intensity equal to at least said predetermined pull-in level so as to actuate said pair of contacts to said closed position, and for subsequently reducing the intensity of said applied magnetic field to an intensity intermediate between said drop-out and said pull-in levels so as to maintain said pair of contacts in said closed position;

the improvement wherein said pair of electrically conductive contacts are selected so as to have a drop-out level which increases substantially with increasing flow of current therethrough;

said overcurrent switch comprising second means for applying said flow of current solely and directly to said pair of contacts whereby, when said overcurrent occurs, said dropout level rises to said intermediate level and said pair of contacts is actuated to said open position so as to interrupt the flow of current therethrough.

2. In an overcurrent switch as recited in claim 1 wherein said first means comprises a permanent magnet, and means for advancing said permanent magnet to a first position of sufficient proximity to said pair of contacts so as to apply said magnetic field of intensity equal to at least said predetermined pull-in level, and for withdrawing said permanent magnet to a second position less proximate to said pair of contacts than said first position so as to apply a magnetic field of said intensity intermediate between said drop-out and said pull-in levels.

3. In an overcurrent switch as recited in claim 1 wherein said first means comprises a permanent magnet fixedly located in proximity to said pair of contacts for providing thereto a magnetic field of said intensity intermediate between said drop-out and said pull-in levels, and means for applying to said pair of contacts a magnetic field of additional intensity, said additional intensity plus said intensity intermediate between said drop-out and said pull-in levels equaling said magnetic field of intensity equal to at least said predetermined pull-in level.

4. In an overcurrent switch serially connected in a circuit for interrupting the flow of current therethrough when a overcurrent is detected, the switch comprising:

a pair of electrically conductive contacts actuable to an open position by application of a magnetic field of intensity equal to or less than a predetermined drop-out level and actuable to a closed position by application of a magnetic field of intensity equal to or greater than a predetermined pull-in level; and first means for initially applying to said pair of contacts a magnetic field of intensity equal to at least said predetermined pull-in level so as to actuate said pair of contacts to said closed position, and for subsequently reducing the intensity of said applied magnetic field to an intensity intermediate between said drop-out and said pull-in levels so as to maintain said pair of contacts in said closed position;

the improvement wherein said pair of electrically conductive contacts are selected so as to have a drop-out level which increases substantially with increasing flow of current therethrough;

said overcurrent switch comprising second means for raising said drop-out level to said intermediate level by applying said flow of current solely and directly to said pair of contacts, whereby said pair of contacts is actuated to said open position so as to interrupt the flow of current therethrough.

5. In an overcurrent switch as recited in claim 4 wherein said first means comprises a permanent magnet, and means for advancing said permanent magnet to a first position of sufficient proximity to said pair of contacts so as to apply said magnetic field of intensity equal to at least said predetermined pull-in level, and for withdrawing said permanent magnet to a second position less proximate to said pair of contacts than said first position so as to apply a magnetic field of said intensity intermediate between said drop-out and said pull-in levels.

6. In an overcurrent switch as recited in claim 4 wherein said first means comprises a permanent magnet fixedly located in proximity to said pair of contacts for providing thereto a magnetic field of said intensity intermediate between said drop-out ans said pull-in levels, and means for applying to said pair of contacts a magnetic field of additional intensity, said additional intensity plus said intensity intermediate between said drop-out and said pull-in levels equaling said magnetic field of intensity equal to at least said predetermined pull-in level.

7. A method of interrupting the flow of current through a circuit when an overcurrent is detected, comprising the steps of:

(a) providing a pair of electrically conductive contacts serially connected in said circuit and actuable to an open position by application of a magnetic field of intensity equal to or less than a predetermined drop-out level and actuable to a closed position by application of a magnetic field of intensity equal to or greater than a predetermined pull-in level, said pair of electrically conductive contacts being selected so as to have a drop-out level which increases substantially with increasing flow of current therethrough;

(b) initially applying to said pair of contacts a magnetic field of intensity equal to at least said predetermined pull-in level so as to actuate said pair of contacts to said closed position;

(c) subsequently reducing the intensity of said applied magnetic field to an intensity intermediate between said drop-out and said pull-in levels so as to maintain the pair of contacts in said closed position; and (d) applying said flow of current solely and directly to said pair of contacts whereby, when said overcurrent occurs, said drop-out level is increased to said intermediate level and said pair of contacts is actuated to said open position so as to interrupt the flow of current therethrough.

8. A method of interrupting the flow of current through a circuit when an overcurrent is detected, comprising the steps of:

(a) providing a pair of electrically conductive contacts serially connected in said circuit and actuable to an open position by application of a magnetic field of intensity equal to or less than a predetermined drop-out level and actuable to a closed position by application of a magnetic field of intensity equal to or greater than a predetermined pull-in level, said pair of electrically conductive contacts being selected so as to have a drop-out level which increases substantially with increasing flow of current therethrough;

(b) initially applying to said pair of contacts a magnetic field of intensity equal to at least said predetermined pull-in level so as to actuate said pair of contacts to said closed position;

(c) subsequently reducing the intensity of said applied magnetic field to an intensity intermediate between said drop-out and said pull-in levels so as to maintain the pair of contacts in said closed position; and (d) raising said drop-out level to said intermediate level by applying said flow of current solely and directly to said pair of contacts, whereby said pair of contacts is actuated to said open position so as to interrupt the flow of current therethrough.

* * * * *

UNITED STATES PATENT AND TRADEMARK OFFICE

CERTIFICATE OF CORRECTION

PATENT NO. : 4,126,841

DATED : November 21, 1978

INVENTOR(S) : Chiaki Maeno

It is certified that error appears in the above-identified patent and that said Letters Patent are hereby corrected as shown below:

Column 1, line 10, delete "is".
Column 1, line 19, "flow" should be --flows--.
Column 1, line 28, "flow" should be --flows--.
Column 2, line 67, "cuasing" should be --causing--.
Column 8, line 34, "dropout" should be --drop-out--.

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*